United States Patent [19]

Ishiguro et al.

[11] 3,955,889

[45] May 11, 1976

[54] APPARATUS FOR STRIPPING RECEPTOR PAPERS FOR USE IN ELECTROPHOTOGRAPHIC MACHINES

[75] Inventors: Tsutomu Ishiguro, Kawaguchi; Hirofumi Shinnishi, Kawasaki; Yukio Katano, Kawaguchi; Kohji Ueda, Tokyo, all of Japan

[73] Assignee: Katsuragawa Denki Kabushiki Kaisha, Tokyo, Japan

[22] Filed: Dec. 11, 1974

[21] Appl. No.: 531,669

[30] Foreign Application Priority Data

Dec. 20, 1973 Japan ..... 48-143226
Dec. 20, 1973 Japan ..... 48-143227

[52] U.S. Cl. ..... 355/3 R; 271/DIG. 2
[51] Int. Cl.[2] ..... G03G 15/22
[58] Field of Search ..... 355/3 R, 3 DR, 3 TR, 355/3 TE, 3 CH; 271/DIG. 2, DIG. 3, 18.1, 18.2; 96/1.4, 1 C; 317/262 A, 2 R, 2 F, 4; 250/324–326, 531; 226/94

[56] References Cited

UNITED STATES PATENTS

| | | | |
|---|---|---|---|
| 3,532,494 | 10/1970 | Bhagat | 317/262 A X |
| 3,620,615 | 11/1971 | Volkers | 355/3 R |
| 3,804,401 | 4/1974 | Stange | 271/DIG. 2 |
| 3,871,980 | 3/1975 | Butcher | 250/531 X |

*Primary Examiner*—L. T. Hix
*Assistant Examiner*—Kenneth C. Hutchison
*Attorney, Agent, or Firm*—Bosworth, Sessions & McCoy

[57] ABSTRACT

In apparatus for stripping receptor paper away from the photosensitive drum of an electrophotographic machine after transfer printing, there are provided a stripping roller having a frictional band near its one end and urged against the photosensitive drum, and a stripping pawl having a pointed end adapted to engage the leading edge of the receptor paper for stripping the receptor paper and urging the same against the frictional band on the stripping roller.

4 Claims, 3 Drawing Figures

APPARATUS FOR STRIPPING RECEPTOR PAPERS FOR USE IN ELECTROPHOTOGRAPHIC MACHINES

BACKGROUND OF THE INVENTION

This invention relates to receptor paper stripping apparatus for use in electrophotographic machines.

As is well known in the art, in an electrophotographic machine it is essential to effectively strip away a printing sheet or a receptor paper from a photosensitive drum after transfer printing a toner or powder image formed thereon onto the receptor paper in order to obtain a satisfactory copy and to prevent failure of the machine. Since an electrostatic latent image is formed on a photosensitive element carried by a rotary drum, and the latent image is developed by applying a powder of toner onto the latent image by the electrostatic attractive force, after completion of the transfer printing there is a tendency that the receptor paper will be adhered to the rotary photosensitive drum by the electrostatic attractive force caused by the latent image. This tendency will be enhanced when the transfer printing is performed under the action of a corona discharge unit as will be described later. When a stripping roller is used to remove the receptor paper from the photosensitive drum, as the receptor paper is rapidly separated away from the stripping roller the potential difference between the surface of stripping roller and the receptor paper increases suddenly thus causing electric discharge by the Paschen' s Law. As a result, the powder of the toner that has been transferred onto the surface of the receptor paper and held thereon by the electrostatic attractive force will be scattered with the result that characteristic scale shaped or tree root shaped discharge patterns are formed on the receptor paper thereby greatly degrading the quality of the reproduced copy.

Heretofore, various receptor paper stripping apparatus have been proposed including a type wherein compressed air is blasted to the interface between the receptor paper and the photosensitive drum, a type wherein a vacuum suction is applied on the back of the receptor paper, a type wherein mechanical pawls are used to separate the receptor paper from the photosensitive drum and a type wherein endless rotating belts are used. However, they cannot accomplish the desired object of effectively stripping off the receptor paper with simple and inexpensive construction.

SUMMARY OF THE INVENTION

Accordingly, it is an object of this invention to provide a new and improved receptor paper stripping apparatus having a simple construction and which can effectively strip off receptor papers.

Another object of this invention is to provide an improved receptor paper stripping apparatus capable of stripping off the receptor papers without scattering the toner on the receptor papers.

According to this invention these and further objects can be accomplished by providing apparatus for stripping receptor paper away from the photosensitive drum of an electrophotographic machine after the latent image formed on the photosensitive drum has been transfer printed onto the receptor paper, characterized in that there are provided an electroconductive stripping roller having a frictional band near its one end, means for urging the stripping roller against the periphery of the photosensitive drum, means for passing the receptor paper about the photosensitive drum through the nip between the photosensitive drum and the stripping roller, and a stripping pawl having a pointed end adapted to engage the leading edge of the receptor paper near a point at which the photosensitive drum and the stripping roller contact each other for stripping the receptor paper away from the periphery of the photosensitive drum and urging the stripped edge of the receptor paper against the frictional band on the stripping roller.

According to a modified embodiment of this invention the stripping roller is covered by a perforated high resistance sheet for the purpose of preventing electric discharge between the stripping roller and the receptor paper as the latter is quickly separated from the former.

BRIEF DESCRIPTION OF THE DRAWINGS

Further objects and advantages of the invention will be more cleary understood from the following detailed description taken in conjunction with the accompanying drawings in which.

DESCRIPTION OF THE PREFERRED EMBODIMENTS

Figure 1:
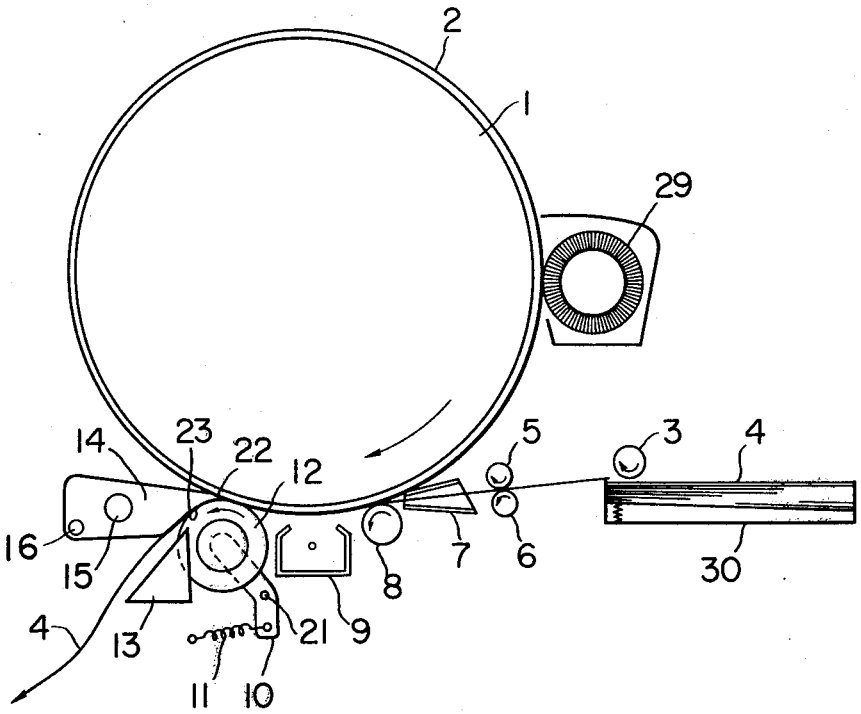
FIG. 1 is an end view of an electrophotographic machine utilizing the recepetor paper stripping apparatus embodying the invention.
Figure 2:
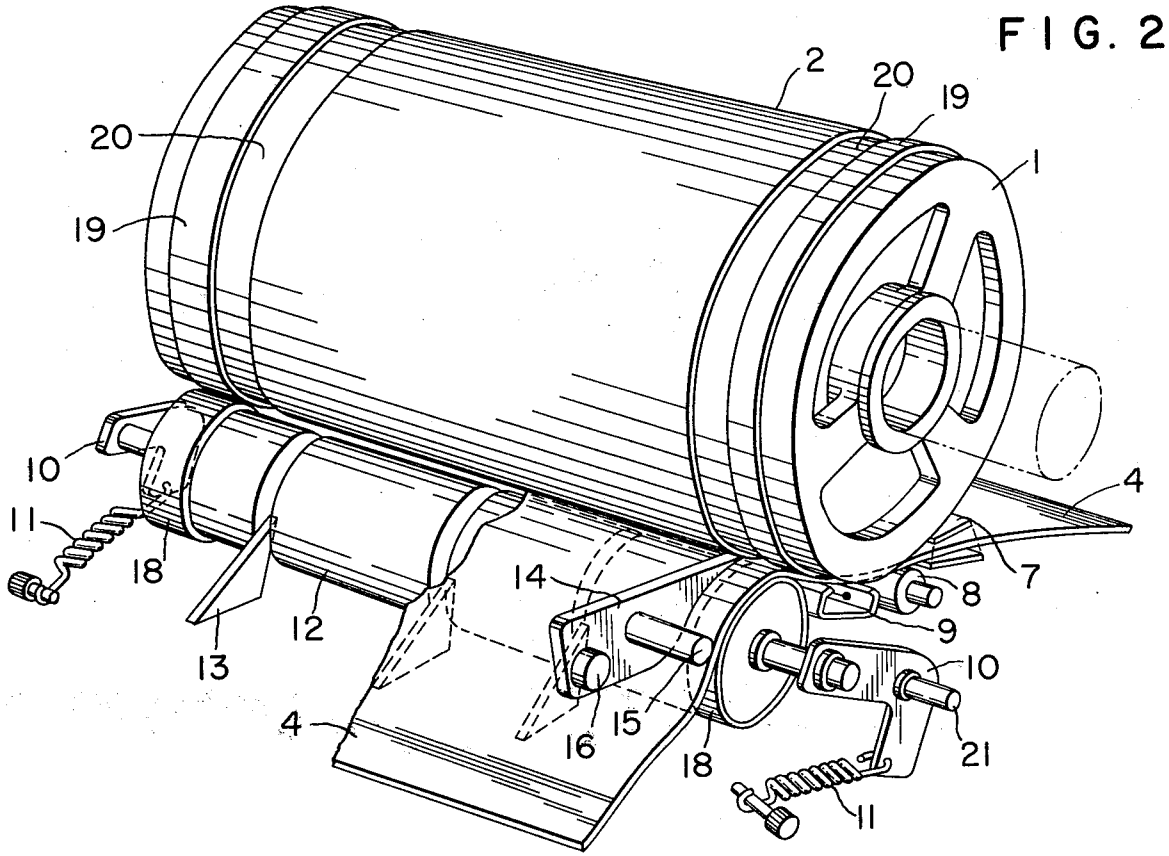
FIG. 2 is a perspective view of the apparatus shown in FIG. 1 with a portion broken away.

The electrophotographic machine illustrated in FIGS. 1 and 2 comprises a rotary drum 1 carrying a cylindrical photosensitive element 2 which may be any one of many well known construction. For example, the photosensitive element 2 may comprise a backing electrode (which may be omitted when the drum 1 is made of metal) and a layer of photosensitive or phosphor material. Depending upon the type of the method of forming an electrostatic latent image, the layer of the photosensitive or phosphor substance may be covered with an insulative layer. In any case, an electrostatic latent image is formed on the surface of the photosensitive element 2 and developed into a visible toner image by a developer 29, in a manner well known in the art.

Receptor papers 4 stacked in a magazine 30 are sent, one by one, to the periphery of the photosensitive drum 1 by a feed roller 3 through pinch rollers 5 and 6 and a guide member 7. The receptor paper 4 is then urged against the periphery of the photosensitive drum 1 by means of a press roller 8 to transfer print the toner images onto the receptor paper 4. Although not absolutely necessary it is advantageous to provide a corona discharge unit 9 in the transfer printing station. After transfer printing, the receptor paper 4 carrying the transfer printed toner image is stripped off from the photosensitive drum 1 by the action of a stripping roller 12 and a pawl 14 in a manner to be described later and is then sent to the succeeding step, a fixing step, for example.

A pair of frictional motion transmitting bands 19 made of elastic material such as rubber is secured near the opposite ends of the photosensitive drum 1, respectively, so that grooves 20 are defined by the photosensitive drum 1, the bands 19 and the photosensitive element 2, as shown in FIG. 2.

In this example, the stripping roller 12 is made of electroconductive material such as aluminum, brass or electroconductive rubber and is grounded. The opposite ends of roller 12 are rotatably supported by bell crank arms 10 pivotally mounted on pins 21. The lower ends of the arms 10 are connected to tension springs 11 to urge the stripping roller 12 against the periphery of the photosensitive drum 1.

A pair of frictional bands 18 made of resilient material, rubber for example, is mounted near the opposite ends of the stripping roller 12 frictionally engage the motion transmitting bands 19, whereby the roller 12 is driven by the photosensitive drum 1 at substantially the same peripheral speed as the drum 1.

In this example, only one receptor paper stripping pawl 14 is provided near one end of the roller 12. The pawl 14 has a sharply ground pointed end 22 and a curved portion 23 having substantially the same contour as that of the curved periphery of the stripping roller 12 and is swingably supported by a pin 15. A weight 16 is mounted on the opposite end of the pawl 14 so as to urge the pointed end 22 against the inside of one groove 20 of the photosensitive drum 1 near a point at which the photosensitive drum 1 and the stripping roller 12 engage each other.

As shown in FIG. 1, it is advantageous that the curved portion 23 of the pawl 14 comprises a circular arc subtending an angle less than 90° because, if the radius of curvature of the curved portion were too small and where the receptor paper were stiff, the paper once separated from the photosensitive drum by the pawl would spring back and adhere to the periphery of the photosensitive drum 1. The result of experiment shows that the receptor paper can best be separated when the curved portion 23 subtends an angle of from 30° to 60°.

The receptor paper 4 passed through the corona discharge unit 9 provided at the transfer printing station tends to continue to rotate while adherring to the periphery of the photosensitive drum 1. However, by the action of the stripping pawl 14, the leading edge of the receptor paper 4 is forcibly separated from the photosensitive drum 1 and is then urged against the frictional band 18 on the stripping roller 12. Since the electrostatic charge applied to the receptor paper 4 at the time of image formation and transfer printing still remains thereon the separated paper will be attracted by the stripping roller 12 thereby facilitating the stripping off of the receptor paper. The stripped paper 4 is guided to the subsequent step by means of a plurality of guides 13.

The relationship between the peripheral speeds of the photosensitive drum 1 and the stripping roller 12 will now be considered. If the difference between these peripheral speeds were too large, the toner image on the receptor paper would be damaged or blurred or cause clogging of the receptor paper in the nip between the photosensitive drum 1 and the stripping roller 12. Accordingly, it is advantageous to make nearly equal these peripheral speeds and to make small the thickness of the resilient bands 18 and 19 sufficient to prevent direct contact of the peripheries of the photosensitive element 2 and the stripping roller 12. Best result was obtained when the gap between the pointed end of the pawl and the periphery of the roller 12 was made to be about 1 mm.

Since the pointed end 22 and the curved portion 23 of the stripping pawl are constantly subjected to the frictional action of the receptor paper it is necessary to form these portions of material having low friction resistance such as metal, nylon, polyamide resins or polyotetrafluoroethylene, to sharply grind the pointed end and to smoothly finish the surface of the curved portion 23.

In this manner, according to this invention there is provided improved apparatus of simple construction capable of efficiently stripping the receptor paper. Furthermore, as only one stripping pawl is suffice it is not necessary to change the position of the pawl for stripping receptor papers of different width, and there is no fear of damaging the toner image by the pawl.

Figure 3:
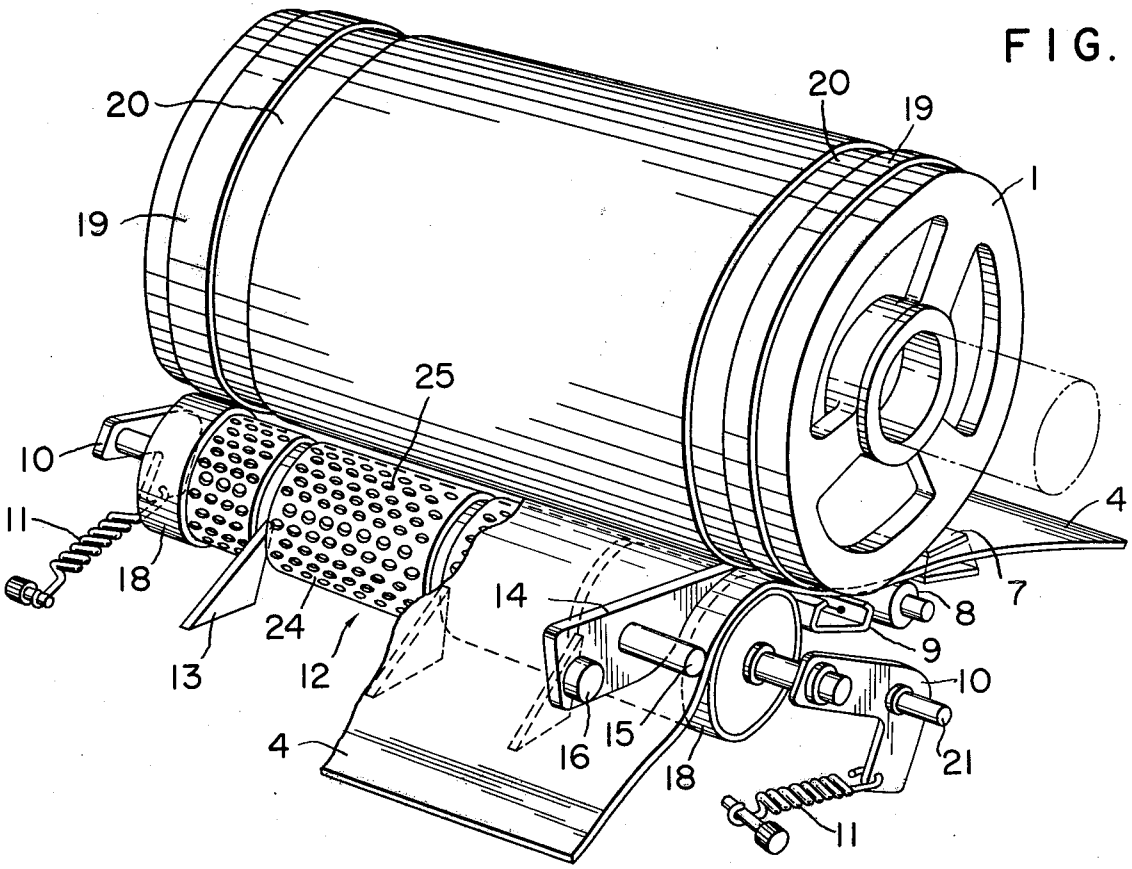
FIG. 3 is a perspective view similar to FIG. 2 but illustrating a modified embodiment of the receptor paper stripping apparatus.

As has been pointed out before when the receptor paper is rapidly separated from the stripping roller, there is a tendency of striking electric discharge therebetween. To overcome this difficulty, in the modified embodiment shown in FIG. 3, the stripping roller 12 is covered by a thin sheet 24 of high resistance material, such as paper or cloth provided with a plurality of perforations 25. The sheet 24 acts to gradually discharge the electrostatic charge on the receptor paper toward the stripping roller. However, since the receptor paper ordinarily utilized in the electrophotographic copying machine generally has a high lateral resistance the charge on the portion of the paper contacted by the high resistance sheet gradually leaks as above described, but the charge on the portion of the paper corresponding to the perforation will be retained. This remaining charge is effective to attract the receptor paper toward the surface of the stripping roller thus preventing rapid separation of the paper from the stripping roller. In this manner electric discharge between the stripping roller and the receptor paper can be efficiently prevented by simple means.

Although the sheet 24 may be made of any high resistance material having a resistance of the order of from $10^9$ to $10^{12}$ ohms, it was found that cotton fabric provides the best result. Further, the diameter of the perforations preferably ranges from 5 to 6 mm.

We claim:

1. In apparatus for stripping receptor paper away from the photosensitive drum of an electrophotographic machine, said drum carrying a photosensitive element thereon, after the latent image formed on said photosensitive element has been transfer printed onto said receptor paper, the improvement which comprises an annular band mounted on one end of said drum so as to define an annular groove between said annular band and said photosensitive element, an electroconductive stripping roller a frictional band mounted on said stripping roller at a position facing said annular band, means for urging the frictional band of said stripping roller against said annular band for driving of said stripping roller by said photosensitive drum, means for passing said receptor paper about said photosensitive drum through the nip between said photosensitive drum and said stripping roller, and a stripping pawl having a pointed end which is adapted to engage the leading edge of said receptor paper near a point at which said photosensitive drum and said stripping roller contact each other and to protrude into said annular groove for stripping said receptor paper away from the periphery of said photosensitive drum and for urging the stripped edge of said receptor paper against said frictional band on said stripping roller.

2. The apparatus according to claim 1 wherein the periphery of said stripping roller is covered by a perforated sheet of high resistance material.

3. The apparatus according to claim 1 wherein said pawl is provided with a curved portion having substantially the same contour as a portion of the periphery of said stripping roller.

4. The apparatus according to claim 3 wherein said curved portion of the pawl subtends an angle of from 30° to 60° with respect to the axis of said stripping roller.

* * * * *

UNITED STATES PATENT AND TRADEMARK OFFICE

CERTIFICATE OF CORRECTION

PATENT NO. : 3,955,889

DATED : May 11, 1976

INVENTOR(S) : Tsutomu ISHIGURO, Hirofumi SHINNISHI, Yukio KATANO and Kohji UEDA

It is certified that error appears in the above-identified patent and that said Letters Patent are hereby corrected as shown below:

Column 3, Line 11, before "frictionally" insert --to--.

Column 4, Line 4, correct the spelling of --polytetrafluoroethylene--.

Signed and Sealed this

Twentieth Day of July 1976

[SEAL]

*Attest:*

RUTH C. MASON
*Attesting Officer*

C. MARSHALL DANN
*Commissioner of Patents and Trademarks*